United States Patent [19]

Ojanen

[11] Patent Number: 4,787,464

[45] Date of Patent: Nov. 29, 1988

[54] VARIABLE RAKE MINE TOOL INSERT AND METHOD OF USE

[75] Inventor: Randall W. Ojanen, Bristol, Tenn.

[73] Assignee: GTE Products Corporation, Stamford, Conn.

[21] Appl. No.: 120,294

[22] Filed: Nov. 13, 1987

[51] Int. Cl.[4] ..... E21B 10/58

[52] U.S. Cl. ..... 175/57; 175/410

[58] Field of Search ..... 175/57, 409, 410, 415; 76/108 A

[56] References Cited

U.S. PATENT DOCUMENTS

| | | | |
|---|---|---|---|
| 3,163,246 | 12/1964 | Vagins et al. | 175/410 |
| 3,198,270 | 8/1965 | Horvath | 175/410 |
| 3,434,552 | 3/1969 | Bower, Jr. | 175/410 |
| 4,268,582 | 5/1981 | Hale et al. | 428/446 |
| 4,314,616 | 2/1982 | Rauckhorst et al. | 175/410 X |
| 4,342,368 | 8/1982 | Denman | 175/410 |
| 4,356,873 | 11/1982 | Dziak | 175/410 |
| 4,489,796 | 12/1984 | Sanchez et al. | 175/410 |
| 4,527,638 | 7/1985 | Sanchez et al. | 175/57 |
| 4,696,352 | 9/1987 | Buljan et al. | 175/57 |

FOREIGN PATENT DOCUMENTS

| | | | |
|---|---|---|---|
| 486235 | 6/1938 | United Kingdom | 175/410 |

OTHER PUBLICATIONS

C. Fairhurst, "The Design of Rotary Drilling Bits", *Mine & Quarry Engineering*, p. 271 (Jun. 1954).

*Primary Examiner*—Jerome W. Massie, IV
*Assistant Examiner*—David J. Bagnell
*Attorney, Agent, or Firm*—Frances P. Craig

[57] ABSTRACT

A mine tool roof bit insert having a leading face inclined at a constant angle of 0°-3° with respect to the axis of rotation, and a frontal face with a variable relief angle decreasing with increasing radial distance from the axis from 25°-55° at the axis to 15°-25° at its radially distal edge, the rate of decrease being at least 10°/in. A method of drilling a hole in a mine roof involves positioning a mine tool including the variable rake bit, insert, or the like, and rotating the bit, insert or the like at about 250-600 rpm and about 1000-8000 lb thrust for a time sufficient to drill the hole in the mine roof.

7 Claims, 1 Drawing Sheet

VARIABLE RAKE MINE TOOL INSERT AND METHOD OF USE

FIELD OF THE INVENTION

This invention relates to mine tool roof bits, inserts for use therein, or the like: and to a method for drilling a hole in a mine roof using such a bit, insert, or the like.

BACKGROUND OF THE INVENTION

The roofs of coal mine shafts require support during a mining operation. This support is provided by roof bolts which are anchored into the rock strata found above the coal seam. In order to attach the roof bolts to the roof of a coal mine, many holes must be drilled into the rock strata and must be spaced closely enough to provide a strong, safe roof in the mine.

The bits or inserts used to drill such holes have radially extending and axially inclined cutting edges formed by intersecting leading and frontal faces of the bit. The leading face is that face which is most closely parallel to the axis of rotation of the bit. The frontal face is that face which is inclined at an acute angle to a radial line normal to the axis of rotation of the bit. The cutting edges of the bits or inserts described above are designed to be sharp so that the drills might be effectively used in the coal or stone material. The bits or inserts must be capable of resisting wear, fracture, and the abrasive action of the chips from the material being drilled. When such drill bits are power driven by high-thrust, high-torque drilling machines, the rate at which the holes can be drilled increases, but the wear experienced by the bits or inserts also increases.

The speed with which holes can be drilled, the maintenance of this penetration rate, and the wear and fracture resistance of the tools are important factors in such drilling operations. Therefore, improvement in any of these factors is desirable, and has to some degree been achieved by changing the composition of the bit or insert material, usually a cemented carbide, by adjusting the carbide grain size, or by changing the bit or insert geometry.

Examples of changes in bit or insert geometry may be found in U.S. Pat. Nos. 4,489,796, 4,527,638, and 4,342,368. U.S. Pat. Nos. 4,489,796 and 4,527,638, both issued to Sanchez et al. describe inserts in which the upper, outside corners have a radius of curvature of 1/16 inch, U.S. Pat. No. 4,527,638 also describing a 30° frontal face relief angle between the top cutting edge and the top trailing edge. This relief angle remains constant from the center to the radially outermost ends of the insert. U.S. Pat. No. 4,342,368, issued to Denman, describes a rotary drill bit, or drill tip for use in such a bit having both a relief angle and an angle of inclination of the leading face which vary along the radius of the bit. The included angle at the cutting edge, defined by the intersection of the frontal face and the leading face, remains constant from the center to the outermost edge of the bit.

The present invention provides mine tool roof bits, inserts, and the like which permit mine roof drilling at high penetration rates, good maintenance of the penetration rates, and longer tool life.

SUMMARY OF THE INVENTION

In accordance with the present invention is provided a mine tool roof bit, an insert for use in a mine tool roof bit, or the like, of the type comprising a flat elongated body rotatable about a central axis and having two halves symmetrical about the axis. Each symmetrical half comprises a planar leading face inclined at a constant angle of 0°-3° with respect to the axis, a frontal face inclined with respect to a radial line intersecting and normal to the axis and inclined with respect to a second line normal to both the radial line and the axis, and a cutting edge defined by the intersection of the leading face and the frontal face. The angle of inclination of the frontal face with respect to the second line decreases with radial distance from the axis, decreasing from 25°-55° at the axis to 15°-25° at its radially distal edge. The rate of angle decrease is at least 10°/inch.

In accordance with another aspect of the present invention is provided a method of drilling a hole in a mine roof involving positioning a mine tool including the mine tool roof bit, insert, or the like described above, and rotating the mine tool roof bit, insert, or the like at about 250-600 rpm and about 1000-8000 lb thrust for a time sufficient to drill the hole in the mine roof.

BRIEF DESCRIPTION OF THE DRAWINGS

The present invention may be better understood by referring to the following Detailed Description and appended Claims taken in connection with the Drawings, in which:

DETAILED DESCRIPTION OF THE PREFERRED EMBODIMENTS

Figure 1:
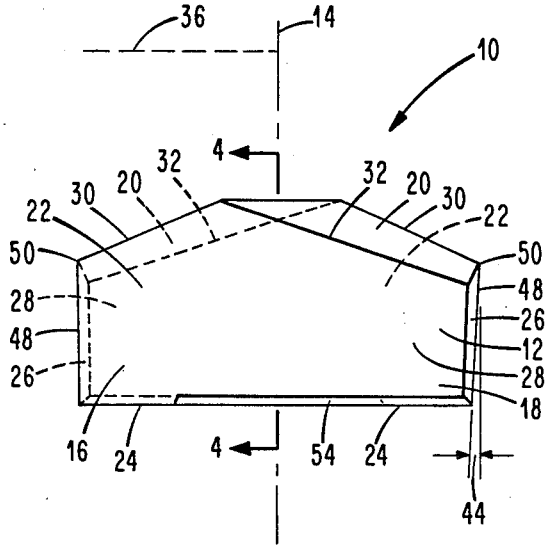
FIG. 1 is an elevation of an insert according to the invention.

Referring first to FIG. 1, there is shown drill bit insert 10 comprising a flat elongated body 12 of a hard, fracture resistant material such as a tool steel, cemented carbide, or the like. Substrate 12 may comprise for example a composite material, the components of which may be uniformly distributed throughout the substrate or, alternatively, the ratio of the components may vary from one region to another within the substrate, such as from the substrate surface to its core. A preferred material for the substrate is a cemented tungsten carbide containing about 5-15 wt. % cobalt as a binder, optionally with other refractory materials, such as cubic refractory transition metal carbides, as additives. The grain size of the substrate tungsten carbide may vary from fine (e.g. about 1 micron), providing a harder insert, to coarse (e.g. about 12 microns), providing a tougher insert, depending on the intended use, the carbide to binder ratio, and the degree of fracture toughness desired.

Figure 2:
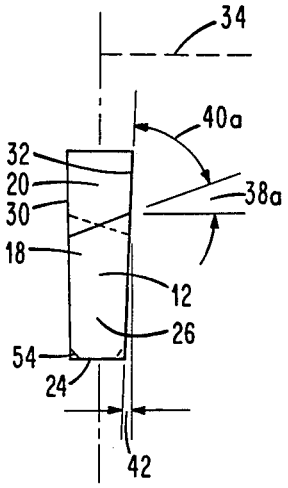
FIG. 2 is an end elevation of the insert of FIG. 1.
Figure 3:
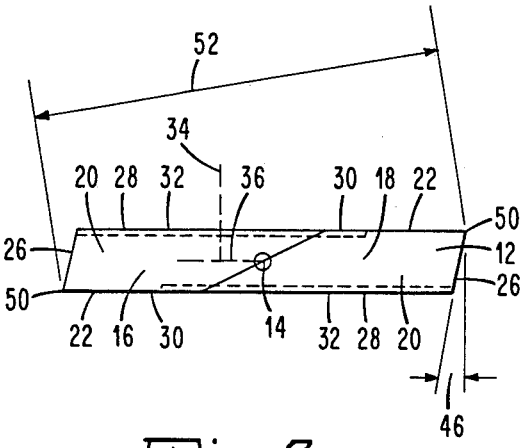
FIG. 3 is a plan view of the insert of FIG. 1.

As shown in FIGS. 1, 2, and 3, insert body 12 is rotatable about axis 14, and is symmetrical thereabout. Symmetrical portions or halves 16 and 18, on opposing sides of axis 14, are each made up of frontal face 20, leading face 22, bottom face 24, end face 26, and trailing face 28. Normally, frontal face 22 of each symmetrical half of body 12 and trailing face 28 of the opposite half are contiguous, forming two flat, planar, opposed surfaces on body 12.

Each frontal face 20 intersects a leading face 22 to define a frontal cutting edge 30. Similarly, each frontal face 20 intersects a trailing face 28 to define a frontal trailing edge 32.

Figure 4:
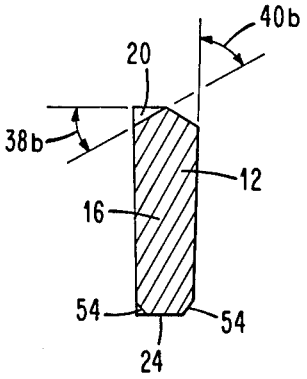
FIG. 4 is sectional view along the line 4—4 of the insert of FIG. 1.

In the bit or insert according to the invention, the relief angle, rake angle, or angle of inclination of frontal face 20 from line 34, normal both to axis 14 and to radial line 36, is not constant, but decreases with radial distance from axis 14. This is illustrated in FIGS. 2 and 4, which are an end view and a view showing a cross section of insert 10 across a plane including axis 14 respectively. FIG. 2 shows angle 38*a*, which is the relief angle of frontal face 20 at the radially outermost end of the frontal face. FIG. 4 shows similar relief angle 38*b*, which is the relief angle of frontal face 20 at axis 14. As may be seen in FIGS. 1, 2, and 4, the relief angle of frontal face 20 with respect to line 34 decreases with radial distance from the axis, decreasing rom 25°–55° for angle 38*b* at the axis, to 15°–25° at angle 38*a* at the radially distal end of the insert. The rate of decrease of the relief angle of frontal face 20 is at least 10°/inch. As may be seen in FIGS. 2 and 4, this results in an increase with radial distance from the axis in the included angle, as 40*a* and 40*b*, at cutting edge 30 of the insert.

The effective path of movement of the cutting edge of a mine tool bit or insert changes along the radius of the insert, the penetration angle of the cutting edge decreasing with increasing radial distance from the axis of the insert. Thus, the clearance angle, i.e. the angle between the frontal face and the path of movement of the cutting edge, in a standard insert having a constant relief angle decreases with decreasing radius, and can be near 0° or even a negative angle at the center of the bit. In the insert according to the invention, the increasing relief angle towards the center of the insert provides a greater clearance angle toward the center of the bit than is normally provided by prior art inserts. Preferably, the clearance angle remains constant along the entire radius of the bit.

The relief angle of the frontal face preferably depends on the penetration rate, and thus the penetration angle, at which the insert will be used. Most preferably the relief angles at all points along the radius of the insert are selected to maintain a constant clearance angle of about 18°–24°.

Leading face 22 of each symmetrical half 16 or 18 of the insert is planar and is inclined at a constant angle with respect to a plane containing the axis. This constant angle of inclination of the leading face, shown as angle 42 in FIG. 2, is preferably 0°–3°, resulting in an insert thickness at bottom face 24 less than or equal to its thickness at frontal face 20.

Constant angle 42 of the leading face with respect to axis 14, combined with the decreasing rake or relief angle of frontal face 20 with increasing radius, provides an insert in which the included angle between frontal face 20 and leading face 22, i.e. at cutting edge 30, increases with increasing radius. The increasing included angle is shown as 40*a* and 40*b* in FIGS. 2 and 4. This increase is a specific advantage of the bit or insert according to the invention, since the radially outermost edges of the insert experience the greatest linear speed during use of the insert, thus experiencing more severe stresses at the cutting edges. The increasing included angle 40*a* toward the radially outermost edges provides increasing strength to the insert at the areas of highest stress, thus increasing resistance to failure of the cutting edges at their radially distal portions.

End faces 26 may also be tapered, narrowing the insert at the bottom face. FIG. 1 shows tapered angle 44, which is preferably about 0°–2° with respect to the axis. End face 26 may also be inclined rearwardly and inwardly toward trailing face 28, providing a relief angle for the end face. FIG. 3 shows relief angle 46, which is preferably about 3°–7° with respect to a plane (not shown) parallel to axis 14 and normal to leading face 30.

Each end face 26 intersects a leading face 22 to define a leading end edge 48 (FIG. 1), which in turn intersects a cutting edge 30 at point 50 (FIGS. 1 and 3). As shown in FIG. 3, opposing points 50 define maximum diameter 52 for insert 10. Maximum diameter 52, also known as the gauge diameter of the insert, is normally of such dimensions as 1 inch, 1 1/32 inch, 1 1/16 inch, 1⅛ inch, 1⅜ inch, 1½ inch, 1⅝ inch, or 1¾ inch.

Alternatively, each end face 26 may meet a frontal face 20 to define a rounded or radiused corner, as described in U.S. Pat. No. 4,489,796 to Sanchez et al., the relevant portions of which are incorporated herein by reference. Each radiused corner includes a point located a maximum distance from the axis, opposing maximum distance points defining a maximum diameter for the insert.

As shown in FIGS. 1, 2 and 4, each trailing face 28, and optionally part or all of leading face 22 contiguous therewith, may meet bottom face 24 at beveled or rabbeted edge 54. These recessed edges may be provided to aid conformation of the insert with the roof bit body slot into which the insert is brazed. Normally, the corners of the slot are provided with fillets, and beveled or rabbeted edges 54 provide clearance for these fillets.

The bits or inserts according to the invention may be utilized in all standard mine tool equipment, and according to the methods commonly accepted in the art. Normally the bit or insert will be fastened to a standard mine tool, which will be positioned to drill a hole in a mine roof, and the bit or insert will be rotated at about 250–600 rpm and about 1000–8000 lb thrust for a time sufficient to drill the desired hole in the mine roof.

The following Examples are presented to enable those skilled in the art to more clearly understand and practice the present invention. The Examples should not be considered as a limitation upon the scope of the present invention but merely as being illustrative and representative thereof.

EXAMPLE 1

The inserts according to the invention were compared with commercially available standard mine tool inserts under simulated mine roof drilling conditions. A standard insert and a variable relief insert were brazed to roof bits and mounted on a standard roof drilling tool. Holes approximately 26 in deep were drilled in medium sandstone at 200 rpm, 3000 lb thrust. The results are listed in Table 1, comparing the power consumed, the insert wear, and the penetration rate for each hole drilled. In the drilling of holes 1–5, comparative results between the standard and variable rake tools show lower power consumption, lower insert wear, and higher penetration rate for the tools according to the invention, the improvement in the penetration rate for each hole varying from 64% to 97% improvement. The variable relief tool was used to drill an additional 5 holes, recording again the power consumption, insert wear, and penetration rate. Averages for these values were compared for the standard and variable tools over the first 5 holes. Averages were also calculated for the variable tool over all 10 holes, comparing the 5 hole average for the standard insert to the 10 hole average for the variable insert. Both comparisons show significant improvement in power consumption, insert wear, and penetration rate using the variable insert under these test conditions.

TABLE 1

| Hole. # | Power, in-lb/min Std. | Power, in-lb/min Var. | Wear, Ave.$V_b$ max,in Std. | Wear, Ave.$V_b$ max,in Var. | Penetration in/min Std. | Penetration in/min Var. | Penetration % Improvt. |
|---|---|---|---|---|---|---|---|
| 1 | 364 | 397 | 0.046 | 0.042 | 30.1 | 49.4 | 64 |
| 2 | 630 | 418 | 0.066 | 0.052 | 26.5 | 46.0 | 73 |
| 3 | 859 | 490 | 0.091 | 0.058 | 22.0 | 41.8 | 90 |
| 4 | 1008 | 520 | 0.122 | 0.070 | 20.3 | 40.0 | 97 |
| 5 | 1139 | 604 | 0.162 | 0.084 | 18.8 | 36.0 | 91 |
| 6 | — | 635 | — | 0.098 | — | 35.2 | — |
| 7 | — | 735 | — | 0.118 | — | 31.7 | — |
| 8 | — | 817 | — | 0.156 | — | 29.3 | — |
| 9 | — | 953 | — | 0.172 | — | 26.1 | — |
| 10 | — | 1268 | — | 0.185 | — | 22.6 | — |
| 5 hole ave. | 800 | 486 | 0.0324 | 0.0168 | 23.5 | 42.64 | 81 |
| 10 hole ave. | | 684 | | 0.0185 | | 35.81 | 52 |

EXAMPLES 2-6

The inserts according to the invention were also compared with commercially available inserts under actual mine roof drilling conditions. The results are shown in Table 2, the variable relief inserts outperforming the standard inserts under all conditions tested except one. This discrepancy may possibly be due to the extremely hard rock encountered during the test. The penetration rates were apparently adversely affected by the extreme hardness of the rock, rather than by the relief angles of the tools.

TABLE 2

| Ex. # | Conditions | Results |
|---|---|---|
| 1 | medium sandstone 1⅜" dia | Penetration rate 52% higher<br>Energy requirement/hole 43% lower<br>Tool life up to 100% longer |
| 2 | Extremely hard sandstone 1⅜" dia | Penetration rate 7% lower |
| 3 | Medium sandstone 1⅜" dia | Penetration rate 29% higher |
| 4 | Very hard sandstone Rotary-percussive drilling 1" dia | Penetration rate approx. same<br>Less Breakage |
| 5 | Med. hard limestone w/softer streaks 1" dia 6200-8200 lb thrust | Drill rate 2-3 sec/4 ft. faster<br>Less breakage at high thrust |
| 6 | Very soft to very hard sandstone Rotary-percussive drilling for harder rock 1" dia | Penetration rate 16-25% higher (ave. 20% higher) |

As illustrated by the above Examples, the mine tool roof bits and inserts according to the present invention provide improved wear resistance, longer tool life, and faster penetration rates during the drilling of holes in mine roofs under a wide variety of drilling conditions. Accordingly, it may be seen that the bits and inserts according to the present invention are a significant advance over the prior art.

While there has been shown and described what are at present considered the preferred aspects of the invention, it will be apparent to those skilled in the art that various changes and modifications can be made therein without departing from the scope of the invention as defined by the appended claims.

I claim:

1. A mine tool roof bit insert comprising a flat elongated body rotatable about a central axis and having two halves symmetrical about the axis, each symmetrical half comprising:

a planar leading face inclined at a constant angle of 0°-3° with respect to the axis;

a frontal face inclined with respect to a radial line intersecting and normal to the axis and inclined with respect to a second line normal to both the radial line and the axis; and a cutting edge defined by the intersection of the leading face and the frontal face; and wherein the angle of inclination of the frontal face with respect to the second line decreases with radial distance from the axis, decreasing from 25°-55° at the axis to 15°-25° at its radially distal edge, the rate of angle decrease being at least 10°/in.

2. A bit insert in accordance with claim 1 having a maximum diameter of about 1 in, wherein the frontal face angle of inclination decreases from about 30° to about 20°.

3. A bit insert in accordance with claim 1 having a maximum diameter of about 1⅜ in, wherein the frontal face angle of inclination decreases from about 30° to about 20°.

4. A bit insert in accordance with claim 1 wherein each symmetrical half further comprises a bottom face intersecting with the leading face; and wherein the leading face angle of inclination is about 0°-3°, tapering downwardly and inwardly toward the bottom face.

5. A bit insert in accordance with claim 4 wherein each symmetrical half further comprises an end face intersecting with the leading face, the frontal face, and the bottom face, and a trailing face intersecting with the frontal face, the bottom face and the end face; and wherein the end face is inclined downwardly and inwardly toward the bottom face at an angle of about 0°-2° with respect to the axis and is inclined rearwardly and inwardly toward the trailing face at an angle of about 3°-7° with respect to a plane parallel to the axis and normal to the leading face.

6. A bit insert in accordance with claim 5 wherein at least the intersection of the bottom face with the trailing face includes a beveled or rabbeted edge.

7. A method of drilling a hole in a mine roof comprising the steps of:

positioning a mine tool including a mine tool roof bit insert comprising a flat elongated body rotatable about a central axis and having two halves symmetrical about the axis, each symmetrical half comprising:

a planar leading face inclined at a constant angle of 0°-3° with respect to the axis;

a frontal face inclined with respect to a radial line intersecting and normal to the axis and inclined with respect to a second line normal to both the radial line and the axis; and a cutting edge defined by the intersection of the leading face and the frontal face; and wherein the angle of inclination of the frontal face with respect to the second line decreases with radial distance from the axis, decreasing from 25°-55° at the axis to 15°-25° at its radially distal edge, the rate of angle decrease being at least 10°/in; and rotating the mine tool roof bit, insert, or the like at about 250-600 rpm and about 1000-8000 lb thrust for a time sufficient to drill the hole in the mine roof.

* * * * *